US007381139B2

(12) United States Patent
Weeks et al.

(10) Patent No.: US 7,381,139 B2
(45) Date of Patent: Jun. 3, 2008

(54) GOLF CLUB FACE POSITION DETECTION SYSTEM

(76) Inventors: Kevin G. Weeks, 11880 Archer Ave., Lemont, IL (US) 60439; James L. Shenoha, 13945 Cherokee Trail, Homer Glen, IL (US) 60491

( * ) Notice: Subject to any disclaimer, the term of this patent is extended or adjusted under 35 U.S.C. 154(b) by 573 days.

(21) Appl. No.: 10/849,365

(22) Filed: May 19, 2004

(65) Prior Publication Data

US 2005/0261069 A1 Nov. 24, 2005

(51) Int. Cl.
*A63B 69/36* (2006.01)

(52) U.S. Cl. ..... 473/155; 473/222

(58) Field of Classification Search ..... 473/151–155, 473/131, 407, 221–225
See application file for complete search history.

(56) References Cited

U.S. PATENT DOCUMENTS 3,194,563 A * 7/1965 Mackniesh ..... 473/222
4,251,077 A 2/1981 Pelz et al.
4,341,384 A * 7/1982 Thackrey ..... 473/222
4,542,906 A * 9/1985 Takase et al. ..... 473/152
5,226,660 A * 7/1993 Curchod ..... 473/155
5,501,463 A * 3/1996 Gobush et al. ..... 473/199
5,718,639 A * 2/1998 Bouton ..... 473/151
6,117,020 A 9/2000 Currie
6,375,579 B1 * 4/2002 Hart ..... 473/131
2002/0098897 A1 * 7/2002 Manwaring ..... 473/151

OTHER PUBLICATIONS

US 5,452,892, 09/1995, Mick (withdrawn)

* cited by examiner

*Primary Examiner*—Mark S Graham
(74) *Attorney, Agent, or Firm*—Dennis A. Gross; The Hill Firm

(57) ABSTRACT

A golf club face position detection system incorporates a light beam reflected off the face of a golf club as the face strikes the ball which activates a circuit to capture the image of the reflected light beam against a target area thereby indicating horizontal and vertical angulation of the face at or near the time of ball contact.

2 Claims, 2 Drawing Sheets

GOLF CLUB FACE POSITION DETECTION SYSTEM

FIELD OF THE INVENTION

This invention relates to sports devices and more particularly to a means and method for detecting clubface attitude at or near the time of contact with the golf ball.

BACKGROUND OF THE INVENTION

It is well appreciated that successful mastery of the game of golf is dependent upon clubface attitude at the moment of impact between the clubface and the ball. While many systems have been proposed to determine the positioning of the clubface (face attitude) at various points during the swing of the club, including at the point where impact with the ball will, or should, occur. Such devices and methods have often been awkward or difficult to use, expensive and prone to misinterpretation or error.

Such devices have often used photography, including video photography, and some have employed laser light sources, light reflection and other techniques for attempting to instantaneously or over time provide an indication of clubface attitude.

Among the various proposed devices are those employing reflective light from the club head, either by means of photo detectors such as taught in U.S. Pat. No. 4,251,077 or using laser devices such as shown in U.S. Pat. No. 5,452,897. Such devices generally assume the position of the club head at the moment of striking a ball either by requiring the club head to be held in a fixed position relative to the light beam or by assuming that the ball would be struck as the club head passes a fixed point. Other devices utilizing laser light sources, such as shown in U.S. Pat. No. 6,117,020 require that the laser device to be fixed to the club head. Such club head attachments would be undesired if the club face attitude is to be indicated as a result of a normal swing since such devices would affect the weight and feel of the club. Devices which are restricted to fixed position club heads, attempting to determine the attitude of the club head at the normal address of the ball position would not accurately reflect deviations encountered during the golfer's normal swing.

It would therefore be an advance in the art to provide a club head attitude detecting device which did not require any substantial modification to the club or club head, did not interfere with the users normal swing, was relatively simple to use and inexpensive to operate.

BRIEF DESCRIPTION OF THE INVENTION

The present invention seeks to overcome deficiencies encountered in the prior art while accurately reflecting the attitude, both loft and alignment, at or near the moment of impact with the ball. To accomplish this result this invention utilizes a reflective surface on the club head which could be a normal polished surface portion of a club head or which could be a relatively small, light and inexpensive attachment to the clubface. A laser is positioned remote from the point of the ball at address generally in the direction of intended ball movement and is positioned to provide a light beam striking the reflective area of the club head. The reflection of the light beam from the club head is displayed on a grid board positioned remote from the ball striking point.

A ball movement detector, such as a photo beam, detects initial movement of the ball as it is struck by the clubface and activates one or more of the laser light source, an indicator or a camera device. In this manner, the attitude of the clubface, both loft and alignment, at or near the moment of impact will be reflected on the grid surface. By integrating the ball movement detector with the laser and/or camera to activate the system at the time of initial impact, the accuracy and repeatability of the system is of significant utility, both in helping a golf instructor to correct the student's swing and in helping a golfer to perfect his own swing or grip, as well as a sales tool in helping the customer select the proper club for the customer's normal swing.

In an embodiment of the invention the laser can be mounted to direct its beam off center from the position of the ball so as to avoid interference with the ball, and the reflective surface if the clubface can be either the heel or toe area of the club face, particularly for smaller face clubs. The reflective area could be provided, for example, by a means as simple as application of reflective tape to a limited area of the club head.

In an embodiment of the invention a base device may be provided having an address position for the user to address the golf ball, a backboard remote from the address position containing the grid board, and a photo eye positioned opposite the golfer aligned with an address area for placement of the ball.

In an embodiment of the invention a laser beam is aimed at the address position of the golf ball where the ball will be struck by the clubface and is positioned to reflect the beam from the clubface to a beam target area remote from the point of address. A photo eye is triggered by initial movement of the ball from the point of address and activates either the laser, a camera trained at the target area, or both. The reflected laser beam striking the target area will then be apparent from the output of the camera substantially as of the moment of striking the ball.

In an embodiment of the invention a ball address area is provided for placement of a golf ball, a laser beam is aimed at the address position where it will be reflected from the club face to a target surface, an indicator light is provided, and a ball movement detector is positioned to detect initial movement of the ball from the address position and to activate the light instantaneously. Observation of the target surface at the instant of activation of the indicator light will indicate clubface attitude at the time of striking of the ball by the position of the reflected light from the laser on the target surface. Observation is recorded by a camera which may be triggered by the ball movement detector.

It is therefore an object of this invention to provide a golf club position indicating method and means for detecting and displaying the attitude of the club face at or near the moment of impact of the clubface with the ball by use of a reflected laser light reflected from the clubface to a target surface. A ball motion detector effective to detect initial movement of the ball from an address point and to activate as a result of such detection one or more of an indicator light, a camera and the laser is provided.

This and other objects of the invention will be apparent to those of skill in the art from the following description of a preferred embodiment, it being understood that others may vary the structure, components and methods from those described in connection with the preferred embodiment while still employing the teachings of this invention.

DESCRIPTION OF THE PREFERRED EMBODIMENT

Figure 1:
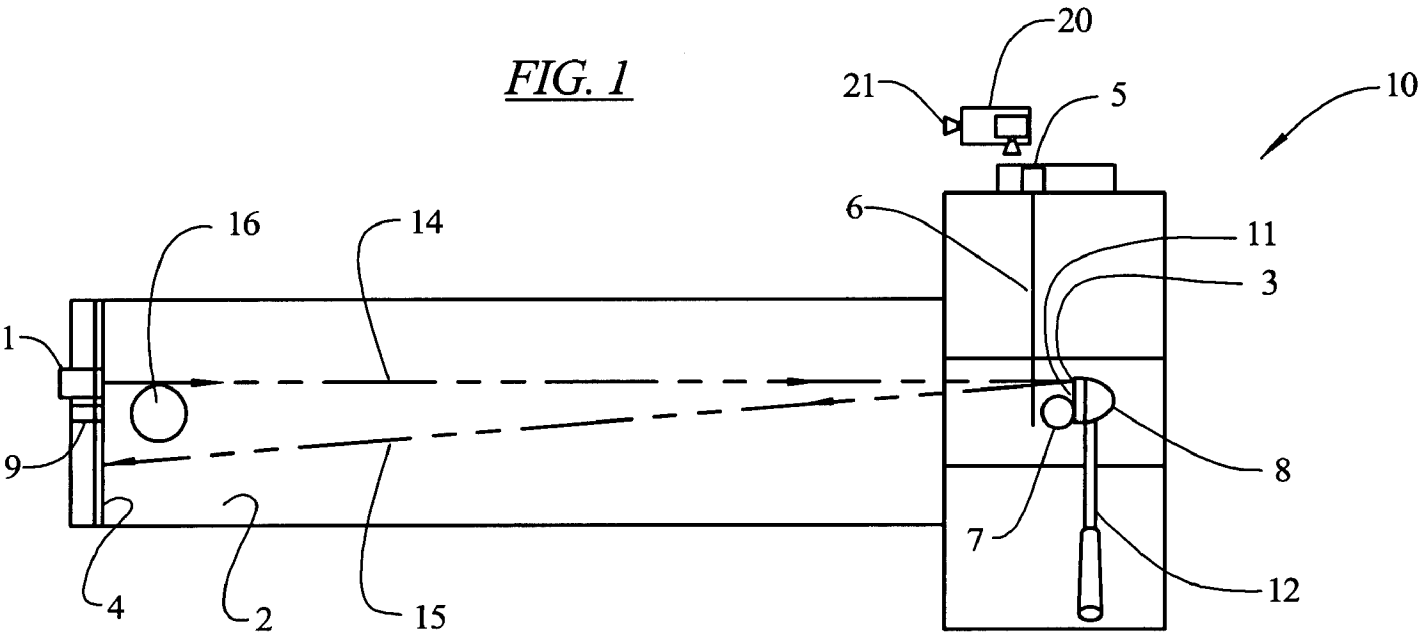
FIG. 1 is an illustration of a top view of an apparatus for detecting and displaying the club face attitude of a golf club at the time of impact with the golf ball.

As shown in the drawings, the golf club fitting systems 10 employs a laser 1 aimed at the face 11 of a golf club 12 at the point where the clubface 11 will be positioned when striking a ball located at an address position 7. The address position may be part of the base member 2 which can form a surface for a ball to roll on. This is particularly useful in the illustrated embodiment for use with putters.

The face 11 of the club has a reflective area 3, illustrated as being adjacent to the toe of the club 12. It will be appreciated that the reflective area may be positioned at other places on the clubface or adjacent the clubface as desired. For example, for left handed golfers utilizing a putter, the reflective surface may be positioned adjacent the heel. For clubs having a naturally shiny surface, the use of reflective tape or other reflection enhancing materials may not be necessary. For larger faced club heads, or where desired to avoid interference with the laser beam due to over or under swing situations the reflective surface may be at an upper portion of the club head. While it is generally preferable that the reflective surface be on or at the face of the club head, for sharply angled clubs, such as a nine iron, where the surface might otherwise direct the reflected laser beam out of detection range, the club head 8 may be equipped with a small secondary surface carried by the club head at or adjacent the clubface and positioned to accurately reflect the laser beam to a target area in a manner indicative of the attitude of the clubface, preferably both with respect to loft and alignment.

Figure 2:
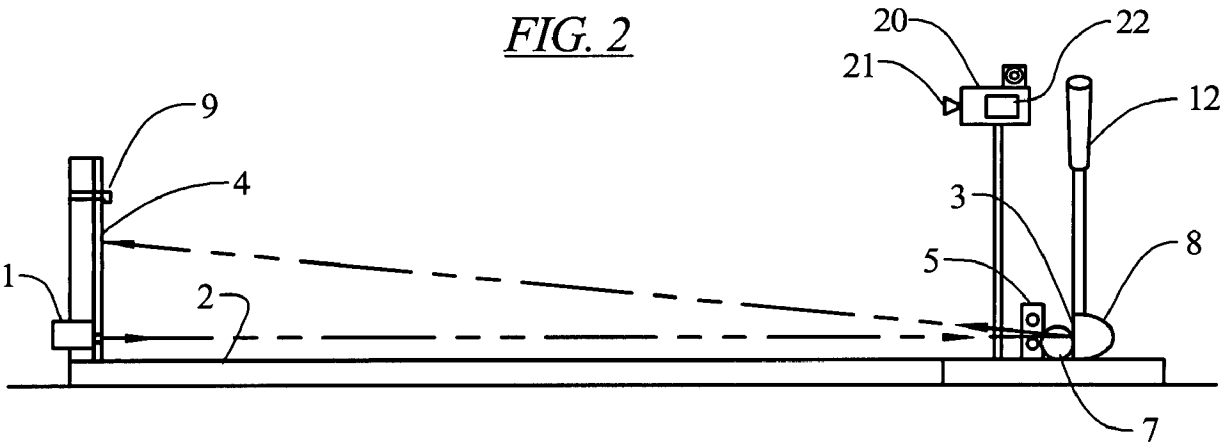
FIG. 2 is a side view of the structure of FIG. 1.

As shown by the broken lines of FIGS. 1 and 2, the beam 14 from the laser 1 is reflected off of the surface 3 along a path 15 towards a target surface 4. The laser 1 may be mounted at the target surface 4 in which case it is positioned off center from the ball address position point 7 such as that the ball does not interfere with the beam 14 from the laser.

Although the target surface 4 is illustrated as being formed as a back stop for the base 2, it will be appreciated that the target surface could be placed elsewhere and that the laser could be mounted other than at the target surface at any point where the beam would, for example, approach the reflective surface 3 at an angle and be reflected back to a more remotely placed target surface. This would be particularly advantageous when the system is used for full swing clubs since it would allow the target surfaced to be positioned outside of the expected flight of the ball.

Figure 3:
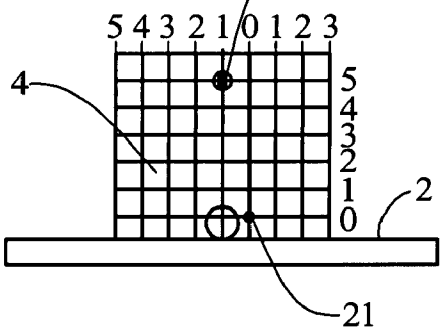
FIG. 3 is a view of the target surface.

As shown in FIG. 3, the target surface 4 may be equipped with a grid having a zero-zero point 21 being the position that would be reflective of, for a putter face of zero loft and zero angulation with respect to the target for the ball. To provide a target for a putter, a cup 16 may be provided in the base 2 aligned with the zero-zero point and directly horizontally ahead of the ball striking position. For other clubs other targets may be provided such as a spot on a ball net. As shown in FIG. 3, if the putter head is angled upwardly with respect to the ball at the time of striking and slightly angled heal in, the reflected beam 15 might strike the grid at the point 17 (having a horizontal grid line 1, loft grid line 5) indicating a slight angulation to the left and a relatively large loft. The face of the target surface 4 may be coated with reflective material chosen to be compatible with the laser.

A ball motion detector 5 is provided to sense initial movement of the ball from the address position. In the preferred embodiment illustrated the ball motion detector 5 may consist of a photoelectric device aimed along a line 6 intersecting the path of the ball immediately, or closely forward, of the ball position at the ball striking address position. As the club contacts the ball, initial movement of the ball will break or reflect a beam from the sensor 5 triggering a signal which can be used to activate one or more of the laser 1, a indicator signal such as a light 9 and a camera or other photo recording device 20. The camera 20 is positioned such that the lens 21 is aimed at the target surface 4. The camera 20 may be a digital camera, video camera, a normal film camera or the like and may include a display 22 for displaying the target surface 4 at the moment of breaking of the beam from the motion detector 5. The camera 20 may, if desired, be positioned behind the strike point and the club back may have an indicator of an optimum alignment point with the ball which could be captured by the camera.

It will be appreciated that the signal from the motion detector 5 will optimally be used to cause the camera to capture the reflection 16 of the reflected laser beam path 15 at the target surface at, or nearly at, the instant of striking of the ball. The use of the indicator light allows confirmation that the output of the camera being used is as of the moment when the ball movement triggers the motion sensor 5.

Figure 4:
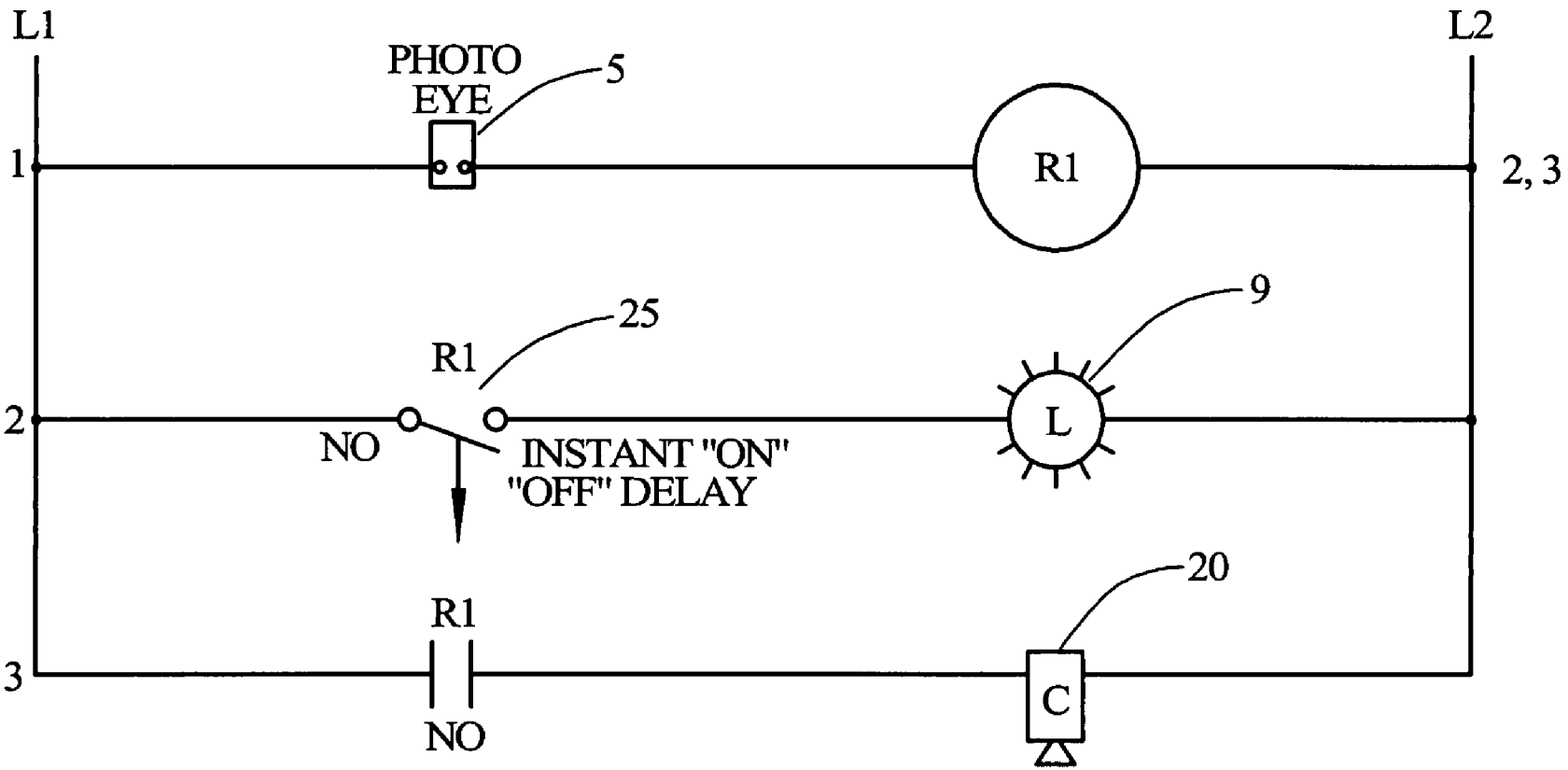
FIG. 4 is a simplified schematic illustrating operation of the apparatus.

FIG. 4 illustrates a simplified circuit where a photo eye is used as the motion sensor 5, and as it detects the breaking or reflection of the beams triggers power to the indicator light 9 and the camera 20. To be sure of capture of the light and to allow the light to indicate that the system was properly activated, an off delay switch 25 may be provided for the light 9. In the schematic illustrated the laser could be on at all times during use of the system, otherwise it could be wired to be activated by the sensor 5.

It will be appreciated that although I have shown my invention in connection with a preferred embodiment, and in particular with one adapted for use with putters, that others may choose to utilize my system in different embodiments. For example, the particular motion detector utilized could be replaced with a sensor located directly at the positioning point of the ball, for example by being associated with a tee or tee holder for use with other clubs, such as drivers. Additionally, the camera could also have a lens focused at the ball position and a split display illustrating both the movement of the club head to and through the ball as well as the target surface, in which instance the camera will be activated throughout the swing of the club and the display could then be used to reflect a more constant view of the person's swing as well as the clubface attitude at the time of contact with the ball by noting the reflected laser beam position at the target surface.

These and other modifications will be apparent to those of skill in the art.

We claim:

1. The method of detecting and displaying the attitude of a golf club face at approximately the time of contact with the ball which comprises the steps of providing a laser beam generator aimed to intersect with the face of a club at a ball address point and to reflect from a surface feature associated with the clubface to a target zone, providing a surface at the target zone adapted to display the reflection of the laser beam and to thereby indicate face attitude of the club, detecting initial motion of the ball struck by the clubface at the address point, and activating a recording device at the time of detection of initial movement of the ball to record the target surface display.

2. The method of detecting and displaying the attitude of a golf club face at approximately the time of contact with the ball which comprises the steps of providing a laser beam generator aimed to intersect with the face of a club at a ball address point and to reflect from a surface feature associated with the clubface to a target zone, providing a surface at the target zone adapted to display the reflection of the laser beam and to thereby indicate face attitude of the club, detecting initial motion of the ball struck by the clubface at the address point, and activating a recording device to record the target surface condition at the time of detection of the initial movement of the ball, including the step of providing an indicator associated with the target zone indicating detection of movement of the ball and recording said indication by said recording device.

* * * * *